US006470952B1

(12) United States Patent
Cline et al.

(10) Patent No.: US 6,470,952 B1
(45) Date of Patent: Oct. 29, 2002

(54) BI-FOLDING DOOR

(76) Inventors: John Cline, 5337 Running Fawn Ct., Alta Loma, CA (US) 91737; Hal Gebert, 16632 Intrepid Ave., Huntington Beach, CA (US) 92649

( * ) Notice: Subject to any disclaimer, the term of this patent is extended or adjusted under 35 U.S.C. 154(b) by 0 days.

(21) Appl. No.: 09/874,334

(22) Filed: Jun. 6, 2001

(51) Int. Cl.[7] ..... E05F 15/00
(52) U.S. Cl. ..... 160/188; 160/199; 160/118
(58) Field of Search ..... 160/188, 206, 160/199, 193, 118, 196.1

(56) References Cited

U.S. PATENT DOCUMENTS

| | | | | |
|---|---|---|---|---|
| 3,554,267 | A | * | 1/1971 | Brinker |
| 4,106,544 | A | | 8/1978 | Dixon et al. |
| 4,534,395 | A | | 8/1985 | Carroll |
| 4,887,659 | A | | 12/1989 | West |
| 4,961,454 | A | | 10/1990 | Reilly, Jr. et al. |
| 5,097,883 | A | | 3/1992 | Robinson et al. |
| 5,109,911 | A | | 5/1992 | Bockisch |
| 5,143,137 | A | | 9/1992 | West |
| 5,152,332 | A | | 10/1992 | Siener |
| 5,295,527 | A | | 3/1994 | West |
| 6,098,695 | A | | 8/2000 | Schwingle |

FOREIGN PATENT DOCUMENTS

| | | |
|---|---|---|
| EP | 14147 | 8/1980 |
| GB | 531417 | 1/1941 |
| GB | 796595 | 6/1958 |

* cited by examiner

*Primary Examiner*—Blair M. Johnson
(74) *Attorney, Agent, or Firm*—Richard C. Litman

(57) ABSTRACT

A laterally symmetrical bi-folding door assembly permits manual operation in the event of a power failure, without requiring readjustment or realignment of any of the door components for operation when power is restored. Each (left and right) door assembly comprises a pair of rigid panels, with the panels hingedly attached to the jamb edge of the door opening having a width substantially half that of the main panels. The two main panels are pivotally secured to upper drive mechanisms along their vertical centerlines, and abut one another along the doorway vertical centerline when the door assembly is closed. When they door assembly is opened, the inwardly disposed edges of the jamb panels and attached outward lateral edges of the main panels, move inwardly. The central edges of the two central panels thus swing outwardly relative to the building structure, due to their vertical centerline attachment to the drive mechanism.

18 Claims, 11 Drawing Sheets

BI-FOLDING DOOR

BACKGROUND OF THE INVENTION

1. Field of the Invention

The present invention relates generally to powered, automated door systems, and more particularly to a laterally symmetrical, bi-folding door assembly having four folding panels comprising a jamb panel and a generally central panel to each side of the center of the door opening. The jamb panels are each approximately one sixth of the width of the door opening, with the central panels each being about one third of the door opening width. The present bi-folding door system includes various novel features, including means allowing the doors to be opened manually without disengaging the doors from their drive tracks or requiring the door system to be reset after such manual operation.

2. Description of the Related Art

Automatically actuated door systems are quite popular in many businesses and other establishments, due to their convenience for customers and others who have occasion to use the doors. Such automated doors can assist in the conservation of energy and maintenance of the interior climactic environment of the building by means of their automated closure systems, and may also provide greater security than conventional manually actuated door systems, regardless of their configuration.

A large number of different automated door configurations have been developed as a result of the above automated door needs, with various types of multiple panel doors which open and close in an "accordion style" operation being quite popular due to their relatively compact configuration when opened. It will be seen that such an arrangement requires that the door panels have a width of only half that of the door opening, where two equal width panels are used. This greatly reduces the space which would otherwise be required for a conventional, side hinged door comprising a single panel. Even more opening space can be saved by providing greater numbers of door panels, with multiple panels disposed to each side of the center of the door opening in a symmetrical array.

However, most multiple panel hinged door configurations have equal size panels. It will be seen that with the outermost jamb panels hinged to the door jambs to each side of the door opening, that the entire width of the door panels must swing to one side (i.e., inside or outside) of the door opening. This arrangement detracts greatly from the otherwise compact opening configuration which might be provided by centering the opened door panels within the door opening. Nevertheless, most manufacturers of multiple: panel doors prefer such equal panel door configurations, as such equal size door panels simplify the geometry of the actuating mechanism and the installation of the door assembly. This is particularly true when considering the various actuating systems of the prior art, where relatively complex mechanisms have been used to open the panels or to draw the panels to a closed position.

Another problem with such multiple panel, laterally and arcuately moving door panels, is that of providing for emergency egress in the event of an electrical power failure. Federal regulations require that any powered, automated door system be capable of being opened by applying a force of no more than a few tens of pounds, close to the center of the door(s). Generally, most automated door manufacturers have responded to this requirement by providing a relatively weak attachment point or link between the center area of the door at its top, and the associated track and drive structure. Thus, a person can push on the center of the door and break the door loose from its attachment in the event of an emergency and loss of power for the door. However, such systems require the door to be reinstalled with its retainer, before the automated function can be reactivated.

Accordingly, a need will be seen for an automated multiple panel door system which overcomes the above problems and further provides a relatively straightforward mechanism for doing so. The present bi-fold door system essentially comprises symmetrical, left and right jamb and primary panels, with the jamb panels having half the width of the primary panels. The jamb panels are hinged to the door jamb or frame along their jamb edges, while the primary panels pivot arcuately about their vertical centerlines as they are moved laterally in the door frame. This configuration results in only about one sixth of the total door width disposed to each side of the door frame when the panels are opened, thus saving substantial room which would otherwise be required for opening the doors.

The present bi-fold door system also responds efficiently to the requirement for emergency egress, with the central edges of the two center or primary panels initially swinging outwardly as the doors are actuated for opening. A manual force of less than thirty pounds is required for a person to push the two central panels open, against the mechanical resistance of the drive belt, transmission, and motor connected thereto. The present bi-fold door retains the mechanical relationships between all components when opened manually, and does not require a person to reset or realign any components after manual opening. Moreover, the present bi-fold door introduces a much more elegant mechanical means for "breaking," i. e., deflecting the plane of the door from the plane of the door frame, at initial opening, in order to reduce linear stresses on the door track drive system.

A discussion of the related art of which the present inventor is aware, and its differences and distinctions from the present invention, is provided below.

U.S. Pat. No. 4,106,544 issued on Aug. 15, 1978 to Guy E. Dixon et al., titled "Electrically Operated Folding Partition," describes an asymmetrical multiple panel folding door having a single half width jamb panel hinged to one jamb, with a series of full width folding panels extending therefrom and across the entire door opening when the door is closed. Dixon et al. require a relatively complex actuation system which initially pulls the doors more tightly closed to align the hinges, before the door may be opened. Positive closure is provided by an essentially opposite action, in which inertia moves the doors past the aligned hinge position and the drive motor then applies a slight opening force to compress the panels along their coplanar disposition within the door frame. Dixon et al. are silent regarding manual opening of their door system, but it appears that the Dixon et al. door system cannot be completely opened by a push upon the central panel(s) in the event of a power failure, as the lead panel is held in a coplanar orientation with the door frame by means of a pair of guides. In contrast, the present bi-fold door invention is symmetrical, and may be completely opened manually by pushing on the central panel(s) of the assembly. Moreover, the motorized opening and closing system of the present door system is greatly simplified over that of the Dixon et al. system, obviating any requirement for additional slight actuating motions to initiate is door opening or closing.

U.S. Pat. No. 4,534,395 issued on Aug. 13, 1985 to William F. Carroll, titled "Folding Door," describes a bi-fold door system wherein the jamb panels are somewhat wider than half the width of the primary panels. This results in the primary panels being asymmetrically disposed within the door frame when the door is opened, unlike the present bi-fold door system. Moreover, as the hinge lines between the two panels on each side fold outwardly, the center edges of the two primary panels move inwardly during normal operation; they cannot be pushed outwardly during manual operation, without disconnecting the doors from their automatic operating mechanism. A mechanic or other person would be required to reset the two primary panels in their ball detent retainers, after manual opening of the Carroll door system. In contrast, the present bi-fold door system moves the hinge lines between each jamb panel and main panel inwardly, thus displacing the central edges of the two central panels outwardly in normal operation. In the event of a power failure, the present bi-fold doors may be quickly and easily opened by pushing outwardly upon the central edges, whereupon the doors travel in their normal motion without being displaced from their actuating mechanism. The automatic operating mechanism of the present door system automatically repositions the doors when power is restored, with the present door system thus requiring no additional intervention to restore normal powered, automated operation after a manual operation.

U.S. Pat. No. 4,887,659 issued on Dec. 19, 1989 to Floyd D. West, titled "High Speed Folding Door," describes a doorway formed of a series of loosely interconnected vertical slats, bearing more resemblance to vertical blinds than to a tightly sealing door. The West door is adapted for use with loading docks and the like, to protect the interior from any weather extremes occurring outside. While West provides for emergency egress by separating the breakaway straps which laterally connect the panels together, the panels do not remain connected as do the hinged together door panels of the present bi-fold door invention. The West panels must be reconnected after separation whereas the present door panels are permanently connected together on each side of the door opening.

U.S. Pat. No. 4,961,454 issued on Oct. 9, 1990 to Paul J. Reilly, Jr. et al., titled "Insulated Folding Door," describes an unpowered, manually operated folding door for use with large, walk-in industrial refrigerators, freezers, and the like. The Reilly, Jr. et al. door is formed of a series of relatively rigid insulated panels which are interconnected by a corresponding series of flexible connectors. The Reilly, Jr. et al. door is laterally symmetrical, with identical numbers and widths of panels to each side of the center of the doorway. However, the various panels of each side assembly of the Reilly, Jr. et al. door are different widths from one another, and fold in opposite directions upon opening. No emergency opening system is provided, as there is no powered operation of the Reilly, Jr. et al. doors. In any event, they cannot both be opened by pushing upon their central frames, they swing in opposite directions from one another.

U.S. Pat. No. 5,097,883 issued.on Mar. 24, 1992 to James W. Robinson, titled "Folding Shutter System," describes a system comprising a large number of extruded panels linked together along their vertical edges to provide an "accordion fold" type action. The Robinson assembly is adapted for use as a storm shutter system, and accordingly is not powered, as such systems are only infrequently closed and opened. Moreover, Robinson does not provide any means for emergency egress, as his shutters are adapted only for closure over a previously closed window or the like; they do not function as a closure for a doorway for normal traffic.

U.S. Pat. No. 5,109,911 issued on May 5, 1992 to Karlheinz Bockisch, titled "Accordion Door," describes an asymmetrical door. system which opens only to one side of the door opening. Moreover, all panels are the same width and pivot about their vertical centerlines, including the panel remaining closest to the jamb when the door is opened. Accordingly, this panel cannot be hinged to the jamb, resulting in relatively low security for the Bockisch door assembly regardless of the materials from which it is made. Moreover, Bockisch does not provide any powered means for operating his door, and thus does not provide any form of manual override means for his door. Normally powered operation and manual override means are a part of the present bi-fold door invention.

U.S. Pat. No. 5,143,137 issued on Sept. 1, 1992 to Floyd D. West, titled "Overlapping Seal For Insulated Folding Door," describes a door system closely related to the door system of the '659 U.S. Patent to the same inventor, discussed further above. The door system of the '137 U.S. Patent includes magnetic means for removably securing the adjacent panels together, rather than the breakaway ties or connectors used in the '659 U.S. Patent. Otherwise, the same differences and distinctions noted further above in the discussion of the '659 U.S. Patent, are see to apply here as well.

U.S. Pat. No. 5,152,332 issued on Oct. 6, 1992 to David Siener, titled "Movable Wall System," describes a multiple folding panel system closely related to that disclosed in the Dixon et al. '544 U.S. Patent discussed further above. The Siener system operates in much the same manner as the Dixon et al. system, using a motor to push the panels slightly toward their open positions in order to cause the hinge line to move slightly over center and "lock" the panel array linearly. However, Siener requires an additional motor and mechanism which is initially activated when the panels are to be opened, with this additional motor and mechanism applying a "breaking" force to push the hinges out of their locked alignment to allow the panels to be folded open. The present bi-fold door includes means for "breaking" the panels from their fully aligned, coplanar configuration when initially opening the doors, but does so by means of an automatically operating mechanical linkage which initially "breaks" the panels from their coplanar alignment and places them in non-parallel planes to allow them to fold for opening, rather than requiring a separate electric motor to accomplish this function.

U.S. Pat. No. 5,295,527 issued on Mar. 22, 1994 to Floyd D. West, titled "Folding Door System," describes another multiple panel folding door adapted for use with loading docks and the like. The folding door of the '527 West U.S. Patent is a continuation of the application which resulted in the '137 U.S. Patent to the same inventor, discussed further above. The differences between the '137 and '527 West U.S. Patent are relatively minor, with both patents disclosing plural folding slats secured to one another by magnetic means. Accordingly, the same differences and distinctions between the present invention and the '137 U.S. Pat. to West, are seen to apply here as well.

U.S. Pat. No. 6,098,695 issued on Aug. 8, 2000 to James P. Schwingle, titled "Stabilizer Arm For A Folding Door," describes a multiple panel door system wherein the lintel member containing the guide and drive means comprises a relatively heavy I beam. The drive means comprises a chain loop, with relatively thin drawbars between the chain and door actuating trolleys to pull and push the doors open and closed. Schwingle provides additional stabilizers which ride on the flanges of the I beams, to preclude bending of the drawbars due to arcuate movement of the door panels and compression on the drawbars. However, Schwingle does not disclose any means of opening his door manually in an emergency, as provided by the present bi-fold door. The panels of the Schwingle system are relatively flexible and are secured together only by a series of rings and grommets. Thus, they are easily deflected manually for passage therethrough without actuating the drive system.

British Patent Publication No. 531,417 accepted on Jan. 3, 1941 to the Educational Supply Association Limited, titled "Improvements In And Relating To Folding And Sliding Doors, Partitions, And Windows," describes an asymmetrical system wherein all the panels fold to only one side of the door opening, unlike the laterally symmetrical system of the present invention. Moreover, all of the panels of the '147 British Patent Publication fold to one side of the door frame (i. e., inside or outside), rather than the central panels being symmetrically disposed within the frame when folded, as in the present invention. No motorized actuation is disclosed in the '417 British Patent Publication.

British Patent Publication No. 796,595 published on Jun. 18, 1958 to J. Avery & Co., titled "Improvements Relating To Folding Doors," describes a multiple panel door system in which the door panels do not pull out completely when extended, but remain in an "accordion fold" state when the door is closed, unlike the present door system. The system of the '595 British Patent Publication is asymmetrical, opening against only one side of the door frame, unlike the present laterally symmetrical system. No motor actuation means is disclosed in the '595 British Patent Publication, and thus there is no motivation to provide a separate system for manual opening of the doors when power is removed, since no power actuating means is provided in the first place.

Finally, European Patent Publication No. 14,147 published on Aug. 6, 1980 to Bernard Chaumat et al. describes (according to the English abstract and drawings) an asymmetrical bi-fold door having a jamb panel slightly less than half the width of the primary panel. The two panels have a relatively complex double hinge connection to allow their completely adjacent and parallel folding, whereas the present system uses a single offset hinge to accomplish the same folding action. The device of the European Patent Publication is motorized, but uses cables wrapped about pulleys at the upper ends of the hinges, rather than trolley actuation as in the present door system. No means for manual emergency actuation is apparent in the '147 European Publication.

None of the above inventions and patents, either singly or in combination, is seen to describe the instant invention as claimed.

SUMMARY OF THE INVENTION

The present bi-folding door provides two laterally symmetrical door assemblies to each side of the centerline of a door opening or frame. Each (left and right) door assembly comprises a pair of rigid panels, with the panel hingedly attached to the jamb edge of the door opening having a width substantially half that of the main panel. The two main panels are pivotally secured to upper drive mechanisms generally along their vertical centerlines, and abut one another along the vertical centerline of the doorway when the bi-folding door assembly is closed.

When the present bi-fold door assembly is opened, the two jamb panels swing about their hinge attachments to the lateral door jambs with their opposite edges moving arcuately to the inside of the structure with which the present door assembly is installed. The outwardly lateral edges of the main panels, i. e., those attached to the jamb panels, move inwardly due to their attachment to the jamb panels. The central edges of the two central panels thus swing outwardly relative to the building structure, due to their vertical centerline attachment to the drive mechanism.

The present invention also includes a mechanism for "breaking" the doors from their coplanar alignment when closed, when the initial opening action is applied by means of the actuating motor. An arcuate cam track communicates with a roller at each drive trolley assembly, with drive force along the plane of the doors driving the rollers outwardly along their tracks and pivoting the central panels from the plane defined by the closed doors.

The present invention also includes means for manual opening, of the doors in the event of a power or drive failure, as required by law. As the central edges of the two central door panels swing outwardly during opening, a person(s) within the structure need only apply a force to the central edges of the central panels in the direction of egress from the structure, to cause the panels to swing open in their normally actuated manner. Sufficient force (on the order of twenty eight pounds or less) applied to the two abutting central edges of the central panels, overrides the mechanical advantage of the motor and speed reduction gearing to drive the actuating system in the direction of opening even though no power is applied to open the system. Thus, the present bi-folding door system remains intact at all times, with no mechanical disconnection of any components being required for manual operation of the doors in the event of a power failure.

When power is restored, the drive system automatically seeks the closed position, with a conventional detector (rotary wheel driven by the motor and optical sensor means, etc.) stopping the motor at the closed position. This same system also stops motion of the drive assembly when the door reaches its fully opened position. Conventional motion detector systems (infrared, threshold pressure plate, etc.) are also incorporated with the present bi-fold door system invention.

Accordingly, it is a principal object of the invention to provide a bi-folding door assembly comprising a total of four door panels, with two panels symmetrically disposed to each side of the center of the door opening.

It is another object of the invention to provide a bi-folding door assembly in which the two panels on each side of the doorway comprise a jamb panel hingedly attached to the jamb and a central panel hingedly attached to its respective jamb panel, with the two central panels each having a width substantially twice that of the jamb panels and pivoting about their vertical axes as they travel along the actuating track of the system.

It is a further object of the invention to provide a bi-folding door mechanism including an automated powered drive mechanism and means for manually opening the doors in the event of a power failure without requiring readjustment or reinstallation of any of the doors or components after such manual operation.

Yet another object of the invention is to provide a bi-folding door mechanism having mechanical means for automatically breaking the doors from their closed coplanar disposition during opening, and for aligning the doors in a coplanar disposition upon closing.

It is an object of the invention to provide improved elements and arrangements thereof for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention comprises an automated bi-folding door for installation and use particularly in entrances to businesses, commercial establishments, etc. The present bi-folding door provides significant advantages over doors of the prior art, in that the present-door does not require any mechanical reconnection or realignment of any components after manual operation in the event of a power failure, as well as other benefits and advantages.

Figure 1:
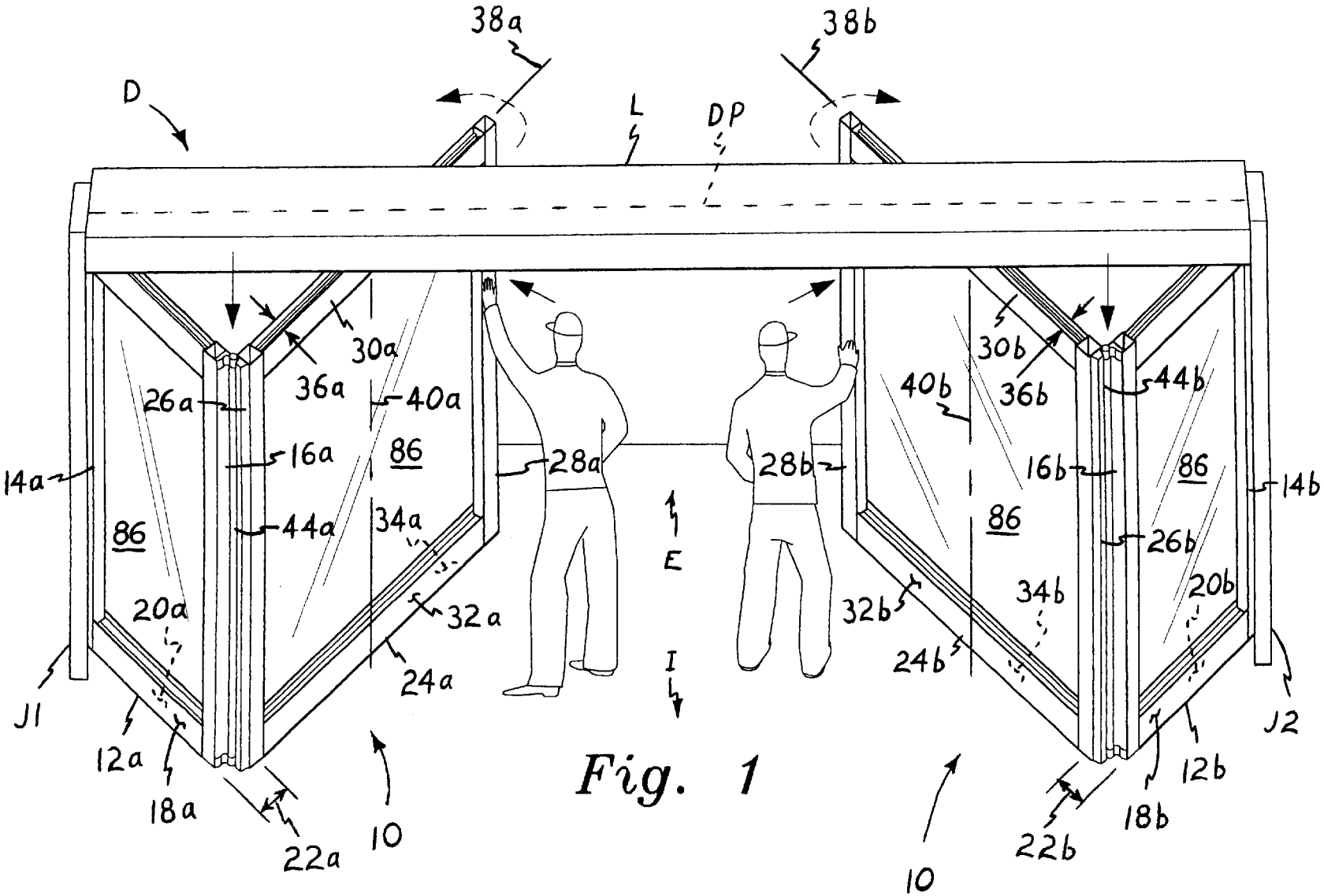
FIG. 1 is an environmental, perspective view of the present bi-folding door, showing the movement of the various door panels during opening manual opening thereof.

FIG. 1 provides a general perspective view of the present automated bi-folding door 10, installed in a doorway D having opposed first and second jambs J1 and J2 and a lintel L, with the jambs and lintel defining a doorway plane DP. The doorway D is installed at the entrance to a building structure, and thus has an interior side I and an opposite exterior side E corresponding to those areas of the building structure.

The door assembly 10 is formed of four rigid panels, comprising first and second jamb panels and first and second main panels. Each of the jamb panels 12*a* and 12*b* has a hinged jamb contact edge, respectively 14*a* and 14*b,* an opposite hinged main panel attachment edge, respectively 16*a* and 16*b,* an interior face, respectively 18*a* and 18*b,* and an exterior face, respectively 20*a* and 20*b,* opposite the respective interior faces 18*a* and 18*b,* with the opposite faces defining a door thickness, respectively 22*a* and 22*a,* therebetween. Each of the main panels 24*a* and 24*b* has a similar configuration, with a hinged jamb panel attachment edge, respectively 26*a* and 26*b,* an opposite main panel contact edge respectively 28*a* and 28*b,* an upper edge, respectively 30*a* and 30*b* an interior face, respectively 32*a* and 32*b,* and an exterior face, respectively 34*a* and 34*b,* with the opposite faces defining a door thickness, respectively 36*a* and 36*b* therebetween. Each main door panel 24*a* and 24*b* defines a door panel plane, respectively 38*a* and 38*b,* with a vertical axis, respectively 40*a* and 40*b,* passing centrally through each respective door plane 38*a* and 38*b* and comprising a folding or pivoting axis for each main door 24*a,* 24*b.*

Figure 2A:
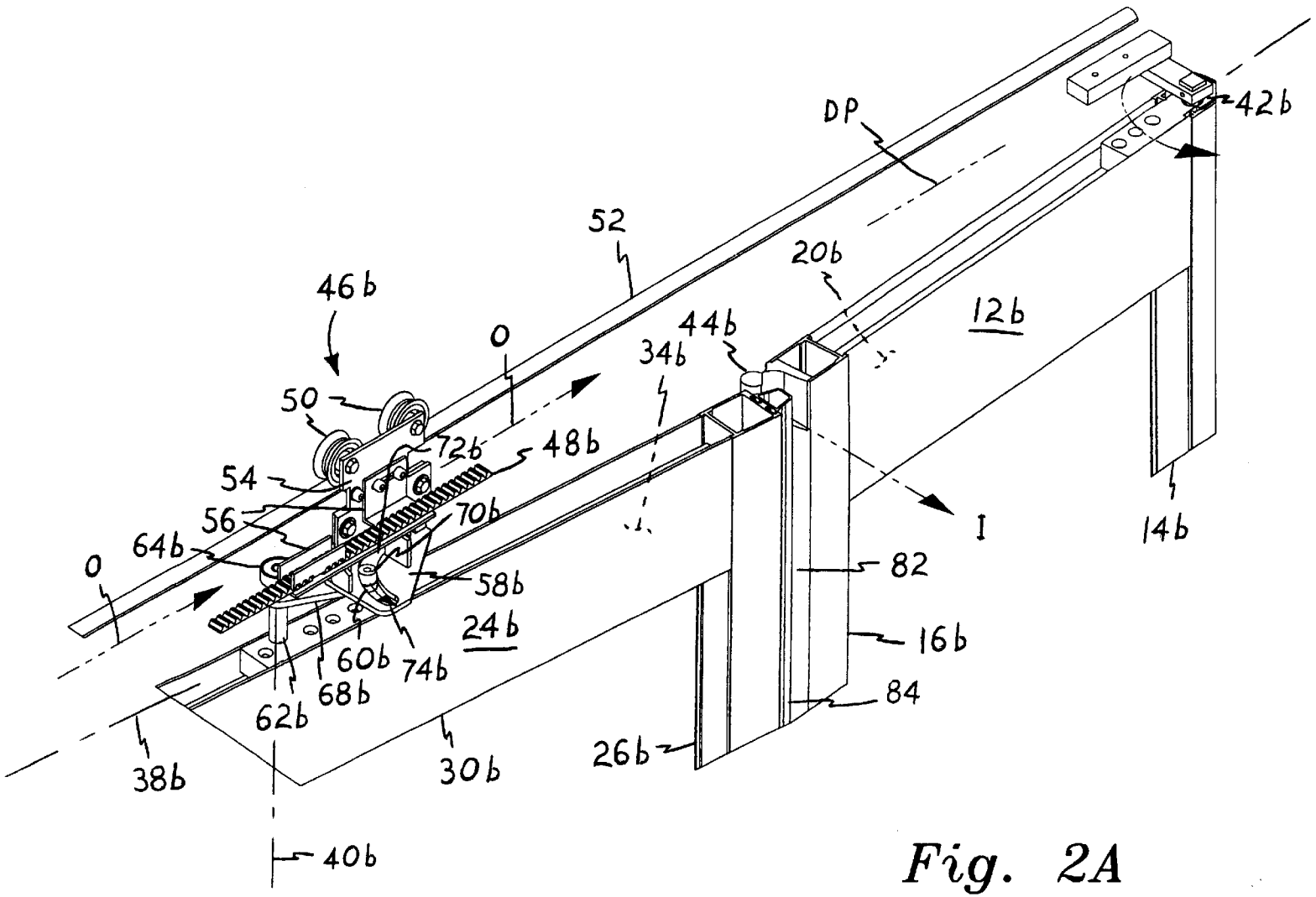
FIGS. 2A, 2B, 2C, 2D and 2E are a series of broken away top perspective views of the second side of the door assembly of FIG. 1, showing the operation of the actuating mechanism and respective door positions during a series of positions during opening of the door, from initial opening to fully opened.
Figure 2B:
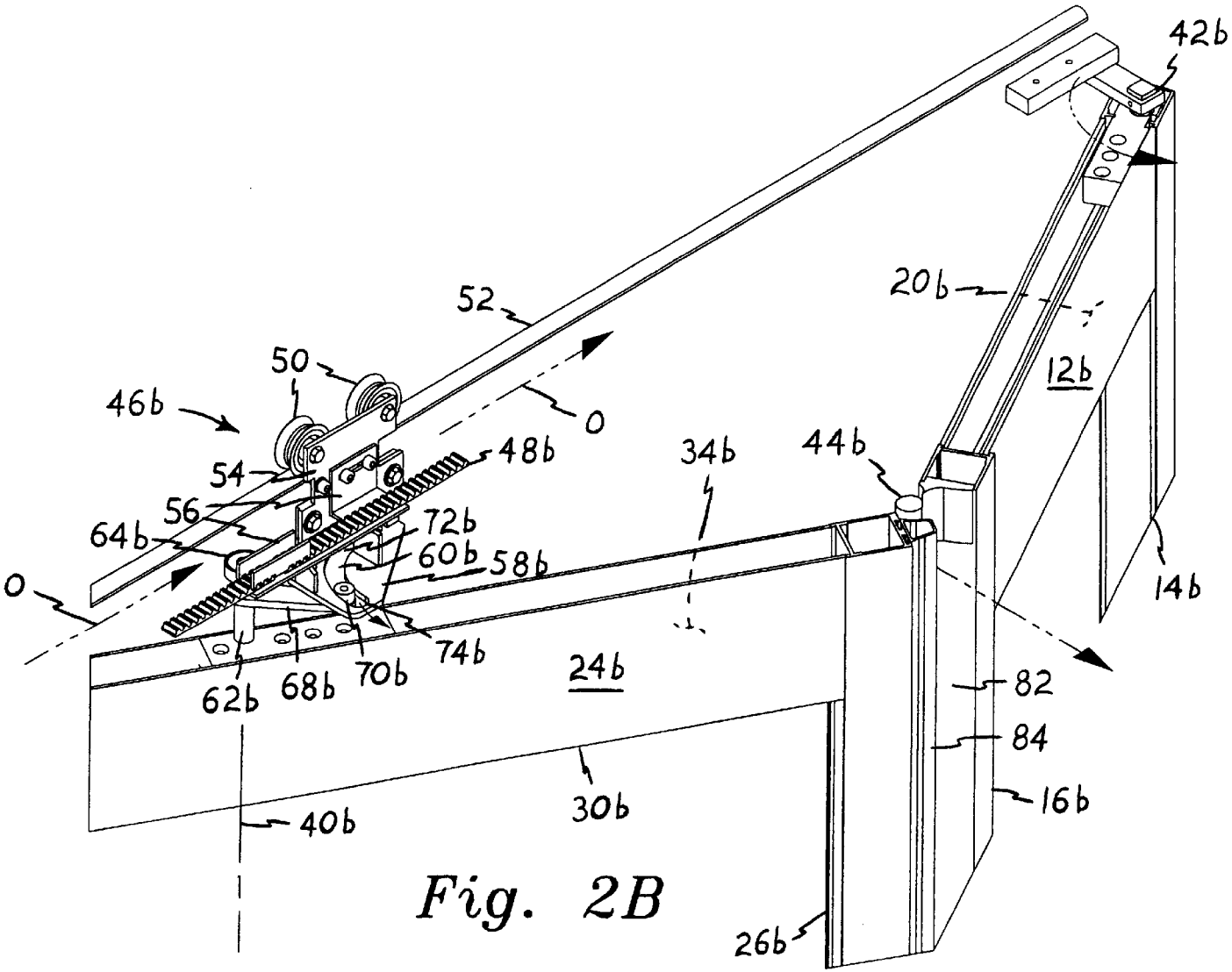
Figure 2C:
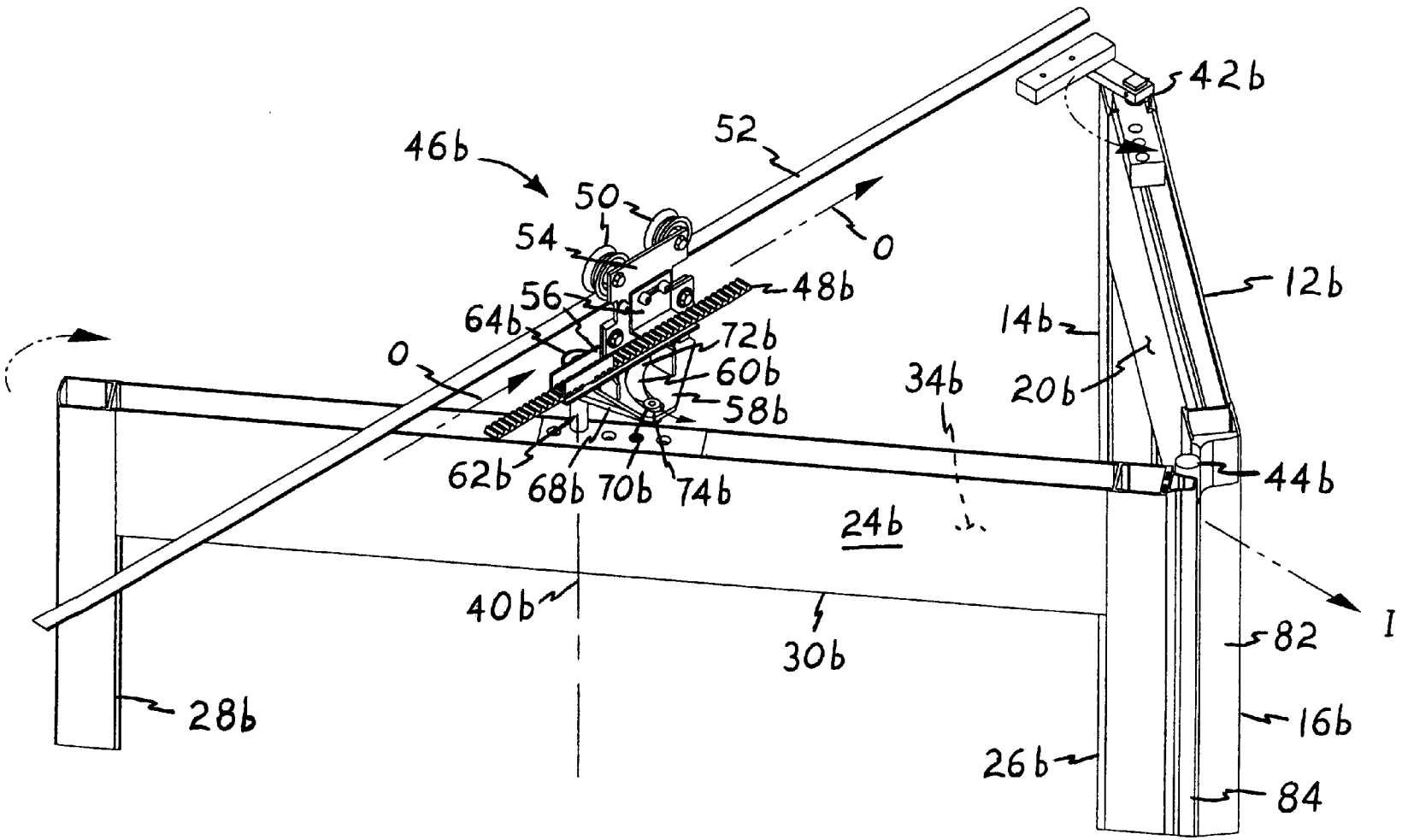
Figure 2D:
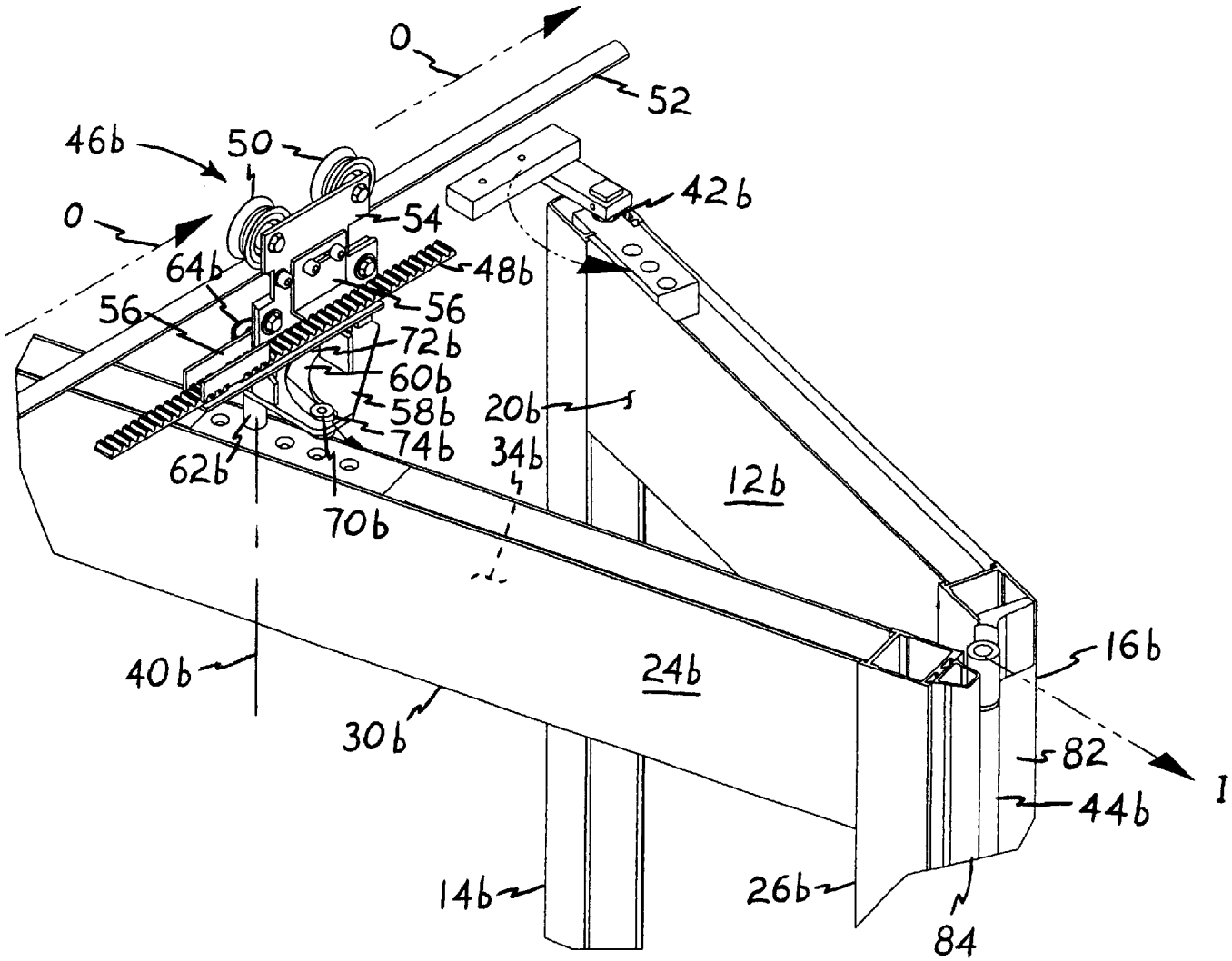
Figure 3A:
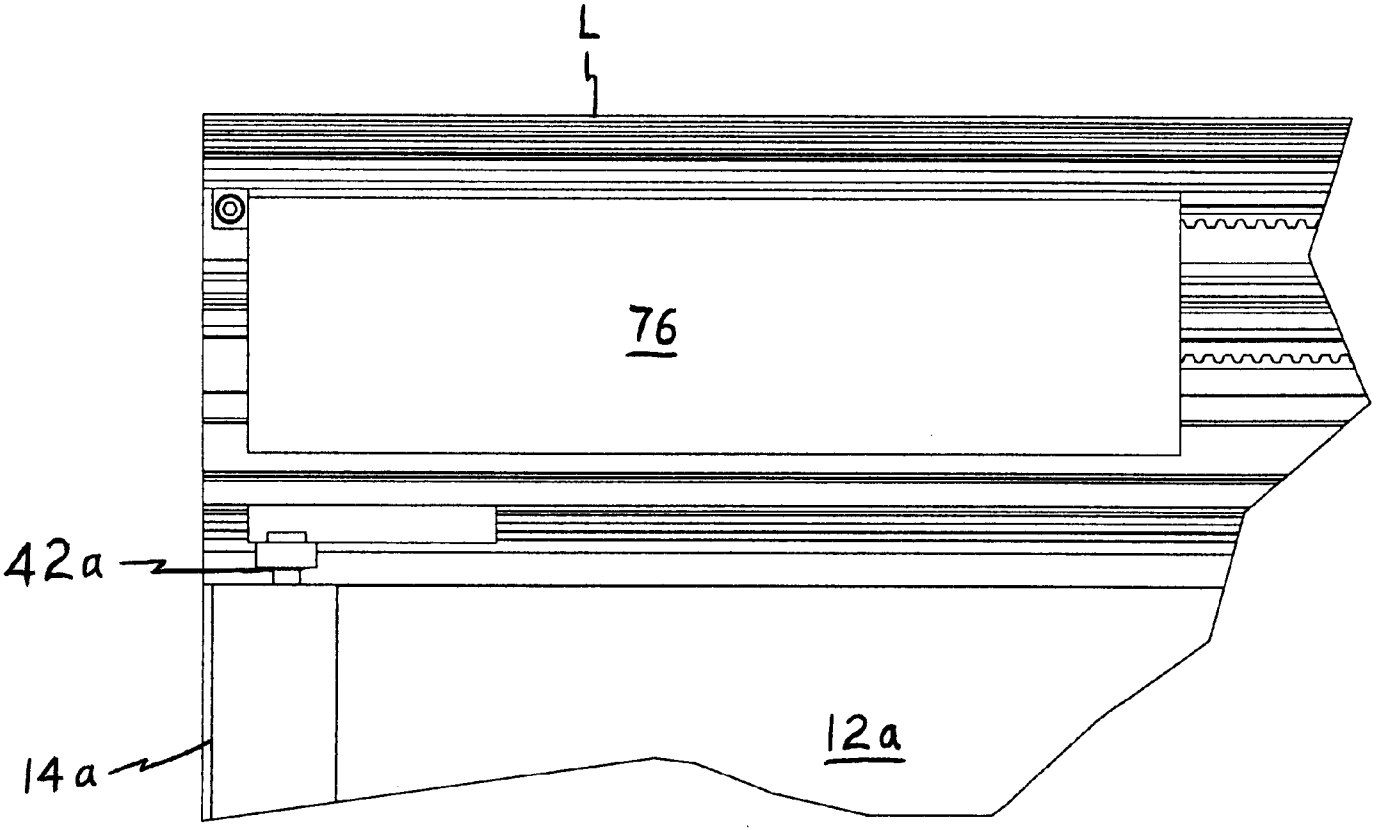
FIG. 3A, 3B, 3C, and 3D are a series of elevation views respectively showing the actuating motor housing, first and second side drive trolleys, and belt return pulley for the drive mechanism of the present door assembly.

Each jamb contact edge 14*a,* 14*b* of the jamb panels 12*a* and 12*b* is secured adjacent its respective jamb J1 or J2 by a hinge pivot, respectively 42*a* and 42*b* (with hinge 42*a* being shown in FIG. 3A, and hinge 42*b* illustrated in FIGS. 2A through 2D and 3D). (Lower hinge pivots, not shown, are also provided opposite the respective upper pivots 42*a* and 42*b*) The opposite main panel attachment edges 16*a,* 16*b* of the two jamb panels 12*a* and 12*b* and the corresponding jamb panel attachment edges 26*a* and 26*b* of the respective main panels 24*a,* 24*b* are secured to one another by some form of hinge means to allow the respective jamb and main panels to move arcuately or articulate relative to one another as the panel are opened and closed. Preferably, continuous hinges, respectively 44*a* and 44*b,* are used to connect the respective jamb and main panels together, for greater security for the installation.

The operating geometry of the present bi-folding door assembly results in an extremely compact folded condition for the doors, requiring very little space extending inwardly or outwardly from the door frame structure. As the jamb panels 12*a,* 12*b* are essentially hinged at their respective jambs J1 and J2, it will be seen that their jamb edges 14*a,* 14*b* cannot move inwardly or outwardly relative to the door frame structure. However, their opposite main panel attachment edges 16*a,* 16*b* and the respective jamb panel attachment edges 26*a,* 26*b* of the main panels 24*a,* must move inwardly toward the interior I of the structure, as the jamb panels 12*a,* 12*b* pivot inwardly about their respective hinges 42*a* and 42*b.*

Figure 2E:
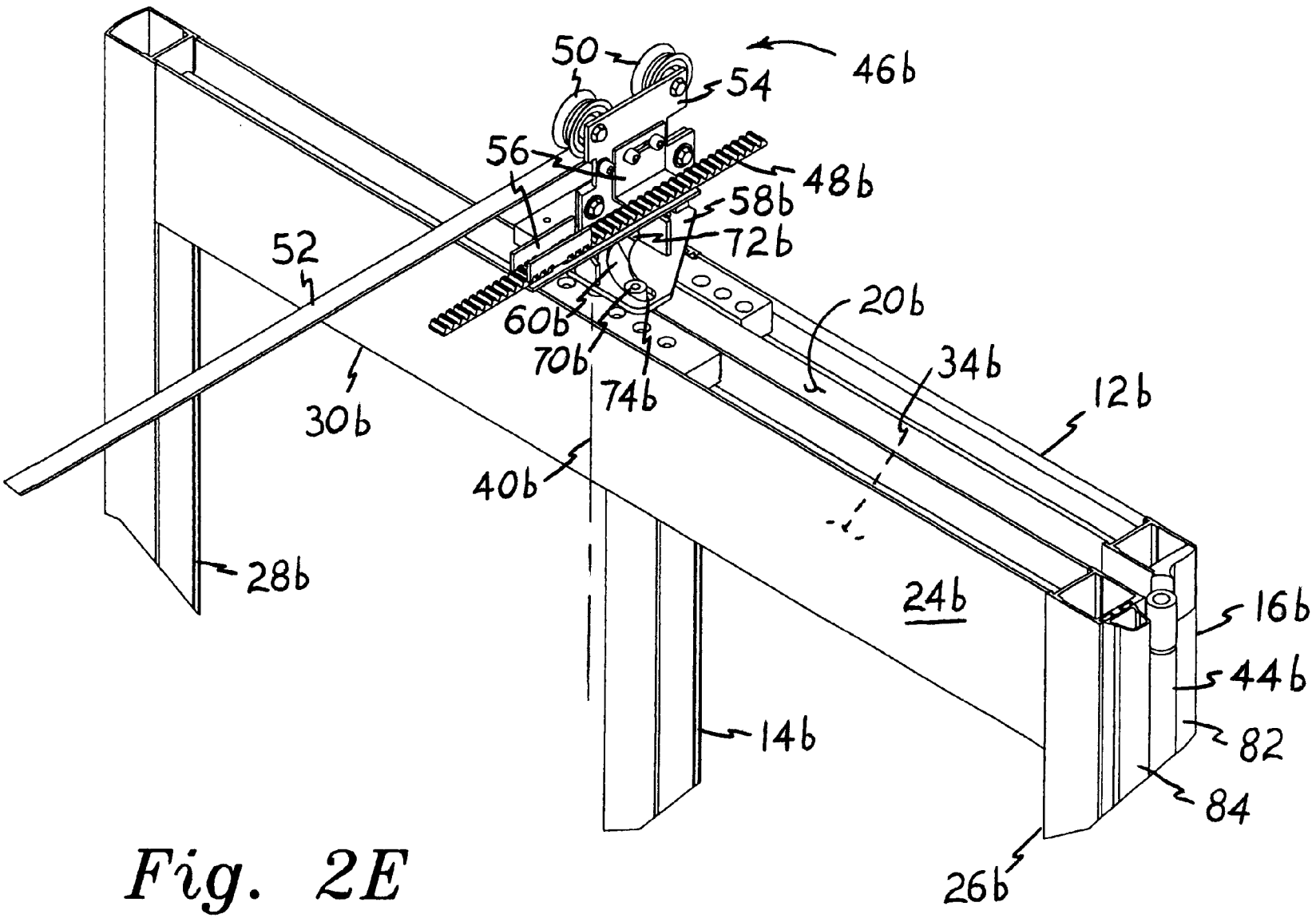

However, the two main panels 24*a,* 24*b* each have widths twice that of the jamb panels 12*a,* 12*b,* as can be seen by inspection in FIGS. 1 and 2E. As the main panels 24*a* and 24*b* are pivotally attached to the drive mechanism at their respective central vertical axes 40*a* and 40*b,* with the vertical axes remaining in the doorway plane DP at all times, as illustrated in FIGS. 2A through 2E and described further below, it will, be seen that the half of each main panel 24*a,* 24*b* toward the center of the door opening (when the doors are closed), must swing outwardly from the door opening, since the opposite half of each main panel swings inwardly due to the hinged attachment of the jamb attachment edge 26*b* to the inwardly swinging jamb panels 12*a* and 12*b.* This provides a significant advantage for manual actuation of the door assembly in the event of a power failure, as discussed in detail further below.

This door assembly configuration also provides significant advantages in compact placement of the opened door panels. Each panel assembly, comprising one main panel 24*a* or 24*b* and its mating jamb panel 12*a* or 12*b,* extends across exactly one half of the width of the doorway opening between the two jambs J1, J2 when the doors are closed, with the first and second assemblies being laterally symmetrical. As each main panel 24*a,* 24*b* is twice the width of each jamb panel 12*a* or 12*b,* it follows that each main panel 24*a,* 24*b* is one third of the total width of the doorway, and that as the main panels are essentially bisected by the doorway plane DP when opened, only one sixth of the total doorway width extends inwardly and outwardly from the doorway plane DP when the doors are opened.

FIGS. 2A through 2E provide a series of top perspective views of the second door pair assembly, comprising jamb door 12*b* and main door 24*e,* showing their articulation from a nearly closed position (FIG. 2A) to a fully opened position (FIG. 2E). The present automated bi-fold door assembly 10 is actuated by an automated drive means, illustrated in detail in FIGS. 3A through 4 of the drawings and described in detail further below. At this point, it is sufficient to note that the drive means includes an endless belt driven by motor means. A pair of trolleys, respectively 46*a* (FIG. 3B) and 46*b* (FIGS. 2A through 2E and 3C), is connected to the respective first and second (upper and lower) drive runs of the belt, respectively belt drive runs 48*a* and 48*b.*

As the belt forms an endless loop, it will be seen that the two runs move in opposite directions to one another when the drive means is actuated. Thus, by connecting the two door actuation trolleys 46*a* and 46*b* to different belt drive runs, i.e., connecting the first trolley 46*a* to the first (upper) belt drive run 48*a* and the second trolley 46*b* to the second (lower) belt drive run 48*b,* the two trolleys 46*a* and 46*b* always move in opposite directions relative to one another when the single motive power source is activated. As the first trolley 46*a* is connected to the first main door panel 24*a* (FIG. 3B) and the second trolley 46*b* is connected to the second main door panel 24*b* (FIGS. 2A through 2E and 3C), the two main panels 24*a,* 24*b,* and their respective jamb panels 12*a* and 12*b* to which they are connected, will travel in opposite directions to one another to open or close the doors when the drive is actuated.

Figure 4:
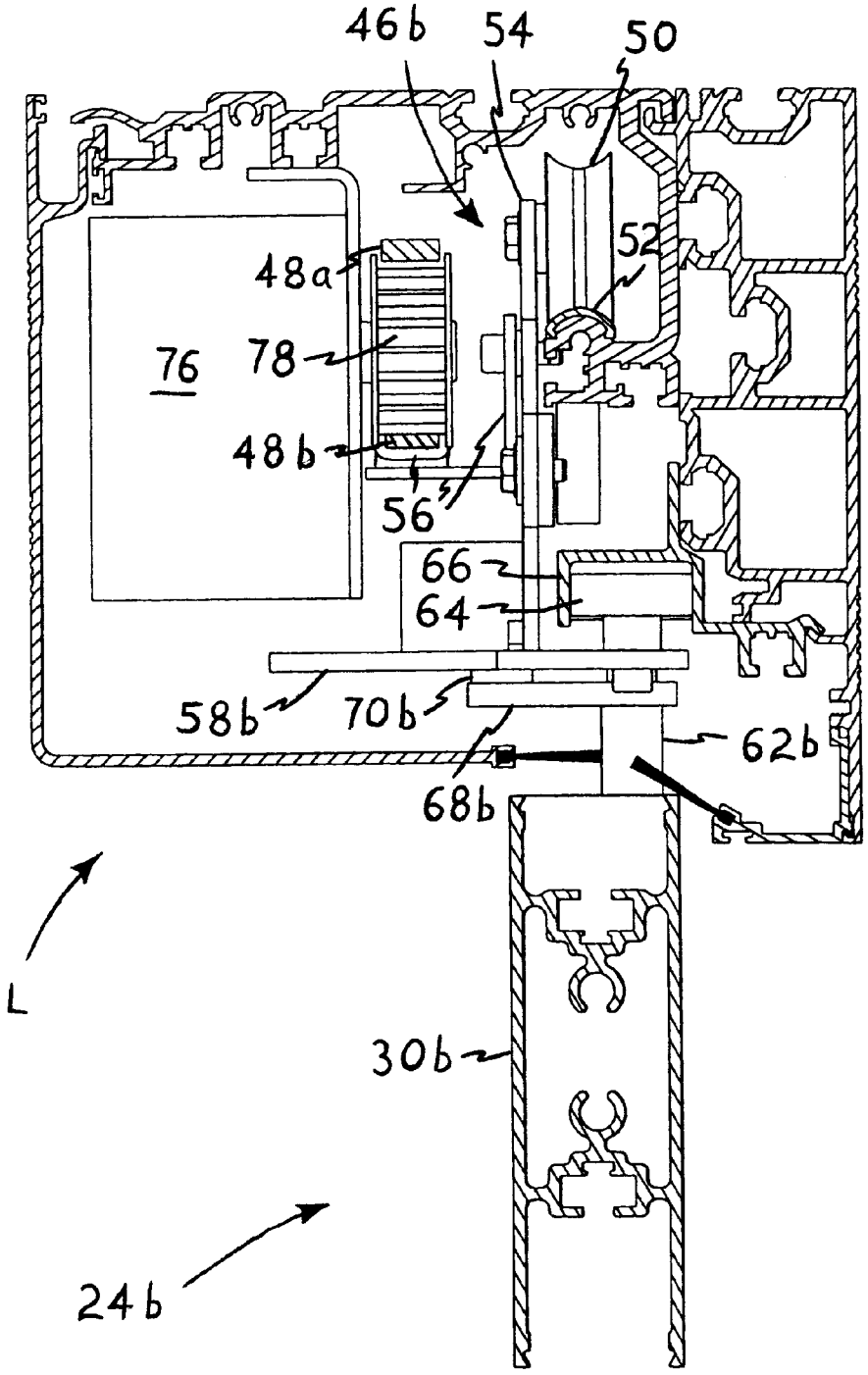
FIG. 4 is an elevation in section along line 4—4 of FIG. 3C, showing further details of the door actuating and drive mechanism.

Each of the trolleys.46*a* and 46*b* includes a pair of wheels 50 which run on a track 52, which is a part of the extruded lintel L assembly shown in detail in the cross section of FIG. 4. (The lintel L is formed of a series of aluminum extrusions, and is more correctly considered a part of the present bi-folding door assembly, rather than a structural component of the building structure in which the present bi-folding door assembly is installed.) The wheels 50 extend from a carriage 54, from which a belt attachment bracket 56 extends to secure to the belt. The only difference between the two trolleys 46*a* and 46*b* is the orientation of the extended belt attachment bracket 56; all of the various components are identical between the two trolleys.

Figure 3B:
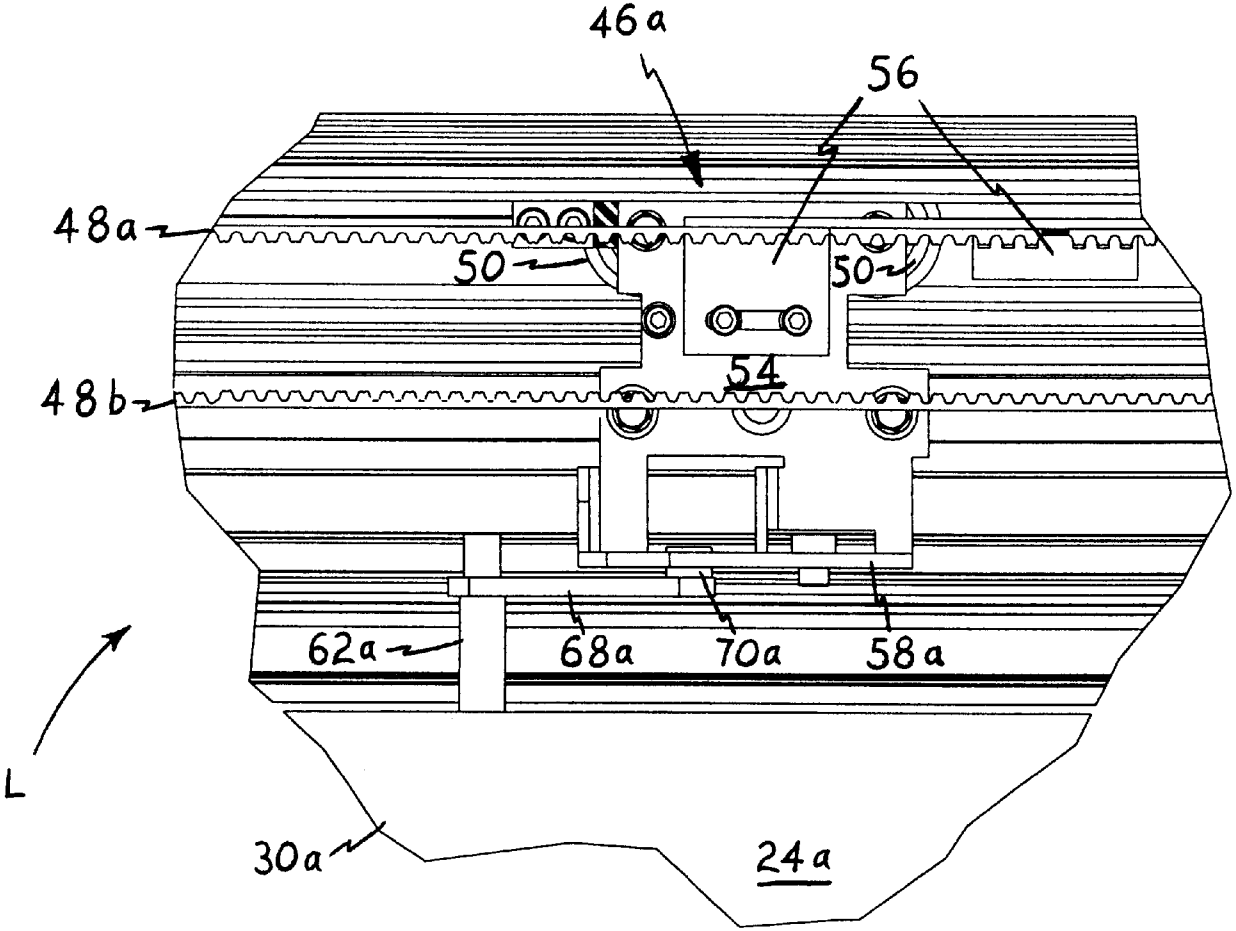

The belt attachment brackets 56 are secured to their respective trolley wheel carriages 54 by a pair of Allen bolts or the like, which pass through a slot in each bracket 56 to provide some adjustment of the assembly. However, the identical belt attachment brackets 56 may be secured to their respective trolley wheel carriages 54 in one of two orientations, 180 degrees apart. This allows either of the belt attachment brackets to be inverted relative to the opposite bracket, for attachment to the opposite side of the drive belt. Thus, the belt attachment bracket 56 of the first trolley assembly 46*a* is inverted, with that bracket being secured to the first or upper belt run 48*a,* as shown in FIG. 3B of the drawings. However, the opposite trolley assembly 46*b* has its belt attachment bracket depending somewhat downwardly to attach to the second belt run 48*b,* as shown in FIGS. 2A through 2E and 3C.

This construction allows a series of identical components to be used to operate either of the two door assemblies (either the first or second door assembly, each comprising one jamb panel 12*a* or 12*b* and corresponding main panel 24*a* or 24*b*) to open and close opposite one another, i. e., to move simultaneously in opposite directions relative to one another upon drive motor actuation. The opposite travel of the two belt runs 48*a,* 48*b* of the single drive belt, and attachment of each trolley 46*a,* 46*b* to a corresponding belt run 48*a,* 48*b,* result in mutually opposed operation of the two door panel assemblies as described above. It will be seen that the belt attachment bracket orientation described above may be reversed, with the belt attachment bracket 56 of the first trolley 46*a* being attached to the second or lower belt run 48*b* and the bracket 56 of the second trolley 46*b* attached to the first or upper belt run 48*a,* with the operation differing only in that the direction of rotation of the drive belt would be reversed during opening and closing operation, from that shown in the drawings.

Each door panel actuation trolley 46*a* and 46*b* includes a cam plate, respectively 58*a* and 58*b,* depending therefrom and extending horizontally toward the interior side I of the assembly from the doorway plane DP, with each cam plate having an arcuate cam slot, respectively 60*a* and 60*b,* formed therein. These two cam plates 58*a* and 58*b,* and their respective cam slots 60*a,* 60*b* are mirror images of one another to provide the desired action. A discussion of the more clearly shown cam plate and slot 50*b* and 60*b* of the trolley assembly 46*b* shown in FIGS. 2A through 2E, is provided below.

The upper edge structure of each main door panel, e. g., the upper edge frame 30*b* of the second main door panel 24*b* illustrated in FIGS. 2A through 2E, includes a generally vertical guide pin, e.g. pin 62*b,* extending upwardly therefrom and generally aligned with the vertical axis (e. g., axis 40*b,* in FIGS. 2A through 2E) of the main door panel, e. g. panel 24*b.* Each pin includes a guide roller, e. g., roller 64*b* for the pin 62*b,* which rides in a main door panel guide track 66, as shown in the cross section of FIG. 4 of the drawings. An inwardly offset arm, e. g. arm 68*b,* extends from the guide pin 62*b.* Each of these arms includes a cam slot roller, e. g., roller 70*b* of FIGS. 2A through 2E, at the distal end thereof. The cam roller 70*b* engages and rides in the respective cam slot 60*b.*

It is desired that when the two door assemblies are closed, that all four door panels be aligned in a coplanar configuration for proper sealing of the doorway and for optimum security. However, some means must be provided for "breaking" the respective jamb and main panels from their coplanar orientation, when the doors are initially opened. The above described assembly provides the means for "breaking" the two panels of each panel assembly, e.g. jamb panel 12*b* and main panel 24*b,* from their coplanar relationship when initially opening the doors from a closed position, and for aligning the two panels 12*b* and 24*b* in a coplanar relationship upon final closing of the doors from an open position. The action of this assembly is illustrated in FIGS. 2A through 2E, and discussed immediately below.

FIG. 2A illustrates the configuration of the,two second door panels 12*b* and 24*b,* immediately after the second (lower) drive belt run 48*b* has begun to move in the direction indicated by the opening movement arrows 0. Initially, trolley 46*b* movement to the left (i.e., closing motion) results in the cam roller 70*b* being drawn to the closure end 72*b* of the cam slot 60*b,* as the drive trolley 46*b* travels toward the doorway center. This results in the offset arm 68*b* pivoting slightly counterclockwise, as the end opposite the cam slot roller 70*b* is restrained by the guide roller 64*b* riding in the channel 66 of the lintel L (shown in FIG. 4). This also urges the main door panel 24*b* to rotate in a counterclockwise direction about its vertical axis 40*b,* to swing the hinge line 44*b* just past alignment with the doorway plane DP and align the main door panel 24*b* (and attached jamb door panel 12*b*) in a coplanar relationship with one another and position them in the doorway plane DP.

In FIG. 2A, the above described closed condition has just been reversed by applying a motive force to the second drive belt run 48*b,* in the direction of the opening arrow O. This results in the trolley 46*b* being drawn in the direction of the opening arrow O as well, which causes the cam roller 70*b* to ride around the arcuate cam slot 60*b* toward the opening end 74*b* thereof, shown by the cam slot arrow. As the vertical axis 40*b* of the main panel 24*b* is held in the doorway plane DP by the guide roller 64*b,* the panel 24*b* must rotate slightly clockwise, thereby swinging the jamb hinge edge 26*b* of the panel 24*b* in the direction of the interior arrow I to "breaking" the doors from their closed, coplanar configuration.

The opening action continues in FIG. 2B, with the second belt run 48*b* of the drive belt continuing to draw the second trolley 46*b* away from the doorway center and toward the second jamb to open the two second panels 12*b* and 24*b* further. The trolley 46*b* has been drawn further in the direction of the opening arrow O by operation of the second drive belt run 48*b* in that direction, thus drawing the cam slot roller 70*b* further in that direction. This results in the cam slot roller 70*b* riding further around the arcuate cam slot 60*b* of the cam plate 58*b,* thus swinging the hinge line 44*b* of the two door panels 12*b* and 24*b* further inwardly. The limited length of the cam slot 60*b* also results in the cam slot roller 70*b,* and thus the attached arm 68*b,* pin 62*b,* and main door panel 24*b,* being drawn in the opening direction as well.

FIG. 2C illustrates a further advanced, i. e., in the opening direction, position for the two door panels 12*b* and 24*b,* wherein the two panels 12*b* and 24*b* have reached approximately their intermediate point in the opening process. Once the "breaking" process has been accomplished and the two panels 12*b* and 24*b* are well removed from their coplanar configuration, the folding action is easily accomplished, with the main panel 24*b* traveling laterally toward the second jamb J2 (shown in FIG. 1) as it simultaneously pivots about its central vertical axis 40*b* and upper pin 62*b.*

In FIG. 2D, the two door panels 12*b* and 24*c* have nearly reached their fully open position. The trolley 46*b* continues to move toward the second jamb side of the door opening, drawing the main door panel 24*b* with it about the main door central axis 40*b.*

Finally, FIG. 2E illustrates the fully opened position for the two second door panels 12*b* and 24*b.* In FIG. 2E, the second belt run 48*b* has been driven toward the second jamb position (to the right in FIGS. 2A through 2E), drawing the second trolley 46*b* with the belt as it moves. This final opening position folds the two door panels 12*b* and 24*b* parallel to one another by means of the hinge 44*b* arrangement between the two panels 12*b* and 24*b,* discussed further below. Closure of the door panels 12*b* and 24*b* is accomplished by reversing the direction of rotation of the drive motor, thereby reversing the direction of travel of the second belt run 48*b* (as well as the first belt run 48*a,* which drives the trolley 46*a* connected to the first main panel 24*a*).

The present bi-folding door assembly is driven by an automated power system, illustrated generally in FIGS. 3A through 3D. FIGS. 3A through 3D provide elevation views in section of a series of broken away portions of the extruded aluminum lintel assembly L, which houses a drive motor, gear reduction system, the drive belt, trolleys, and means for limiting motion of the doors at their fully opened and closed positions. In FIG. 3A, the drive motor and gear reduction assembly 76 are shown generally and schematically by a rectangular box, which would conventionally contain the motor and gear reduction. The electric motor and gear reduction system (worm gear drive, etc.) are conventional, and need not be described in detail here. The motor and gear reduction assembly 76 drive a toothed drive wheel 78 (shown in FIG. 4), which in turn drives the drive belt with its upper and lower runs 48*a* and 48*b.*

FIG. 3B provides a side elevation view of a portion of the lintel L with the first trolley 46*a* disposed therein, connected to the first main panel 24*a.* As noted further above, the belt attachment bracket 56 of the first trolley 46*a* assembly is inverted relative to the arrangement of the second trolley 46*b,* with the first trolley belt attachment bracket shown connected to the first or upper belt drive run 48*a* in FIG. 3B. It will be seen that rotation of the drive wheel 78 in a counterclockwise direction (as viewed from the orientation of FIG. 3A) results in movement of the second or lower belt run 48*b* to the right, as illustrated in the description of operation of FIGS. 2A through 2E, and movement of the first or upper belt run 48*a* to the left, thus drawing the first and second panel assemblies apart during opening. Reversal of the direction of rotation of the motor results in clockwise rotation of the drive wheel 78 (again, as viewed in FIG. 3A), which draws the two trolleys 46*a* and 46*b* together to close the doors.

Figure 3C:
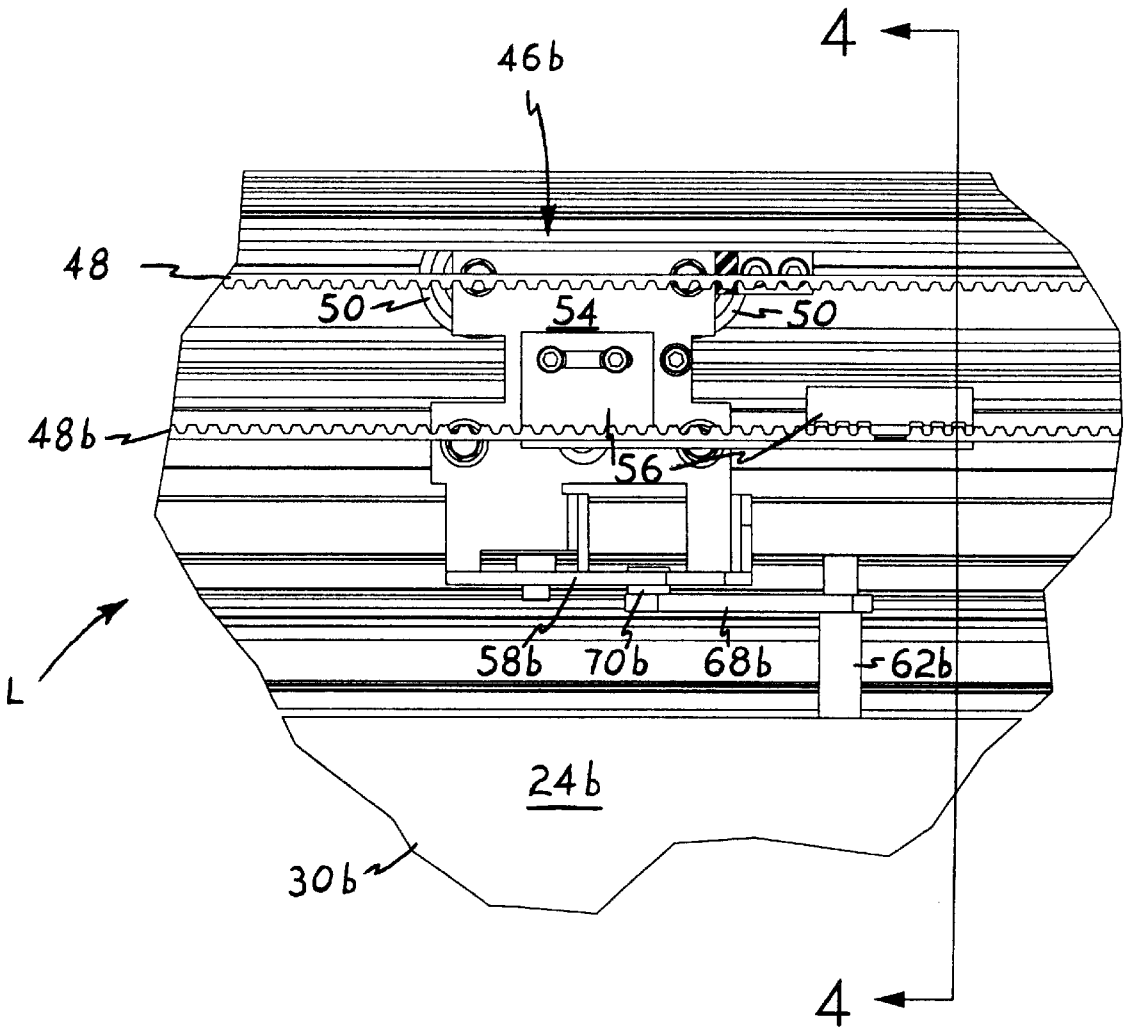

FIG. 3C provides an elevation view of the second trolley assembly 46*b* and its connection to the second main panel 24*b.* This is essentially the structure illustrated in the perspective views of FIGS. 2A through 2E, with the operation discussed further above.

Figure 3D:
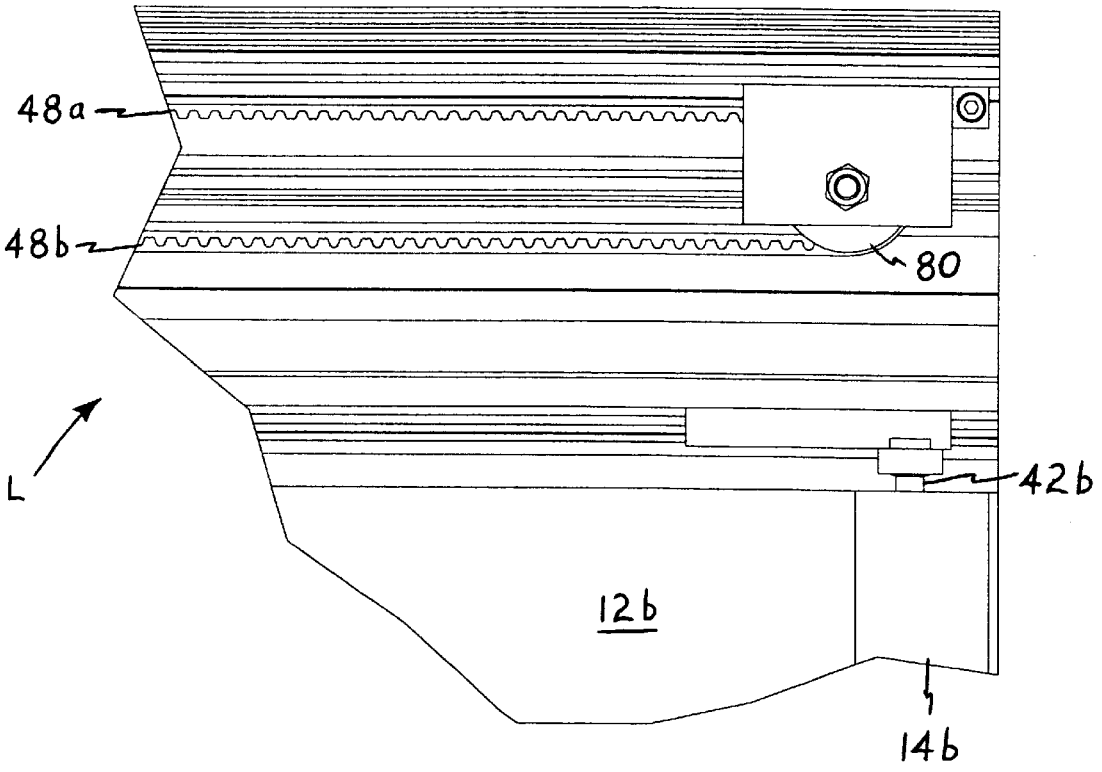

Finally, FIG. 3D discloses the general structure of the opposite end of the lintel assembly L from the motor and drive system 76 shown in FIG. 3A. An idler pulley 80 and bracket are provided at this end of the lintel L, in order to keep the belt taut and provide for reversal of direction of the two belt runs 48*a* and 48*b.*

The above described pivoting and lateral travel of the door panels 12*a,* 12*b,* 24*a,* and 24*b* of the present invention provide a significant advance in emergency operation, which has not been achieved prior to the present invention. As the main panels 24*a* and 24*b* pivot about their respective central vertical axes 40*a* and 40*b* as they are guided laterally along the upper track or lintel L, it will be seen that substantially one half of each main panel 24*a* and 24*b* extends inwardly relative to the door frame, and that the opposite main panel halves extend outwardly from the frame. As the offset cam roller arms 68*a,* 68*b* and their rollers 70*a,* 70*b* engage their corresponding cam slots 60*a,* 60*b* to the inboard side of the assembly, the main panels 24*a,* 24*b* are caused to pivot so that their jamb panel connecting edges 26*b* are pivoted inwardly relative to the door frame. Thus, their opposite main panel contact edges 28*a,* 28*b* must swing outwardly relative to the doorway plane DP during opening of the doors, as shown generally in FIG. 1.

This motion of the doors occurs whether the doors operate by power means, or manual means. In the event of a power failure, persons within the structure need only apply a relatively low pressure (less than thirty pounds) against the interior face of either (or both) of the main panel contact edges 28*a,* 28*b* of the main panels 24*a,* 24*b,* to force those panels (and their attached jamb panels 12*a,* 12*b*) to open, as shown in FIG. 1. As the drive belt is positively connected to each of the main panels 24*a,* 24*b* and to the drive motor, this causes the belt to move, which rotates the drive wheel 78 and the gear reduction system and motor 76.

As the main or center panels 24*a* and 24*b* are directly attached to the smaller pivoting jamb panels 12*a* and 12*b,* each panel assembly 24*a,* 12*a* and 24*b,* 12*b* acts as a single unit when an actuating force is applied (either via the motor and belt drive, or manually) to the leading or contact edge(s) 28*a* and/or 28*b* of either or both of the main panels 24*a* and/or 24*b.* In effect, all of the panels 24*a,* 12*a,* 24*b,* and 12*b* are connected to the single drive belt comprising first and second belt runs 48*a* and 48*b* by means of the corresponding assemblies 54a through 70*b,* as noted further above.

Thus, an outward manual push on either of the two mating edges 28*a* or 28*b* of the two respective main panels 24*a* or 24*b,* not only forces that specific panel 28*a* or 28*b* outwardly, but also pivots the opposite panel (either 28*b* or 28*a*) outwardly as well, due to the interconnection of the two panels 28*a* and 28*b* through the single drive belt. The corresponding jamb panels 12*a* and 12*b* of course pivot toward the door jambs as well, due to their hinged, attachment to their respective main panels 24*a* and 24*b.*

Accordingly, a manual push on either of the mating or contact edges 28*a* or 28*b* of the main panels 24*a* or 24*b* acts to open all four panels 12*a,* 12*b,* 24*a,* and 24, effectively doubling the size of the opening provided by applying force to only one set of panels, i. e., panels 12*a,* 24*a* or 12*b,* 24*b.* Once the manual door opening force has been removed, the doors 12*a,* 12*b,* 24*a,* and 24*b* automatically reset to their fully closed positions when electrical power is applied to the system, as described generally below.

Most of the force required to open the doors manually is due to the mechanical disadvantage provided by the gear reduction of the motor, which resists the force input required for opening the doors. However, the entire mechanism remains intact during manual operation, and does not require any reconnection of components, recalibration, or other mechanical or electrical work for normal operation once power is restored. Conventional positional sensing means, not shown, may be provided to signal the motor to reposition the doors to an initially closed position when power is restored. This may be accomplished by means of a conventional slotted rotary wheel driven by the drive system, with a light (visual, infrared, etc.) and photoelectric pickup for emitting and detecting light passing through the wheel slots. The motor drives to its normally closed position as determined by the sensor wheel, when power is restored. As all of the mechanism remains intact after emergency manual operation, the doors automatically close and are once again ready for normal, automatically powered operation once power is restored.

The present bi-folding door invention provides a further safety benefit, as well. It is critical that the interconnected door panels, i. e., each jamb panel and its attached main panel, be configured to preclude capture of any article within the hinge gap between the panels. As the hinges are in the same general plane as the exterior surfaces 20*a,* 34*a,* 20*b,* and 34*b* of the four panels, the present invention also includes means for preventing capture of articles (clothing, fingers, etc.) in the gap opposite the hinges.

FIGS. 2A through 2E disclose the hinge arrangement between the second jamb panel 12*b* and second main panel 24*b,* showing the means provided to preclude inadvertent capture of any articles between the two panels. The hinge arrangement for the first two panels 12*a* and 24*a* is a mirror image of that shown for the two panels 12*b* and 24*b* in FIGS. 2A through 2E. The hinge 44*b* is essentially coplanar with the exterior surfaces 20*b* and 34*b* of the two panels 12*b* and 24*b,* as noted above. This arrangement provides for the complete, folding of the two panels 12*b* and 24*b* parallel to one another for compact disposition when the door panels are opened, as shown in FIG. 2E. This hinge configuration results in unidirectional folding action, as the thickness of the panels precludes folding in the opposite direction. This is not a problem with the present bi-folding door invention, as only unidirectional folding is desired.

However, the hinge 44*b* is also extended laterally from the respective hinge attachment edges 16*b* and 26*b* of the two panels 12*b* and 24*b.* This results in a relatively wide relief area 82 (i. e., on the order of an inch or so) between the adjacent main panel hinge edge 16*b* of the jamb panel 12*b* and the jamb panel hinge edge 26*b* of the main panel 24*b,* when the doors are closed and positioned in a mutually coplanar order to one another. A relatively soft, resilient seal 84 may be provided along one or both of the adjacent door panel edges 16*b* and/or 26*b,* providing sufficient flexure to allow a person to withdraw articles of clothing, fingers, etc. from the gap 82 when the doors are closed. Similar seals may be placed between the jamb edges 14*a,* 14*b* and respective jambs J1 and J2.

In conclusion, the present bi-folding door invention provides numerous benefits and advantages over earlier folding door mechanisms. The simultaneous pivoting and retracting action of the doors during their opening operation, swings the two mating main panel contact edges of the main panels outwardly, in the natural direction of travel of persons desiring to exit the building structure. While this is not critical during normal powered operation of the doors, it permits the doors to be operated manually by persons within the building, to allow their exit. Persons desiring to leave a structure having the present doors when electrical power has been interrupted, need only push outwardly on either or both of the mating contact edges of the main panels to actuate the entire door operating system manually. The doors swing open normally, driving the drive belt, drive wheel, gear reduction system, and drive motor, with no disconnection or damage to any components.

The present bi-folding doors may include any practicable means for automatic operation, as desired. Conventional microwave or threshold pressure detection of approaching persons may be used to activate the present doors automatically, as desired. Threshold detection may be independent of other detection means, in order to hold the doors open even though other means (microwave, etc.) do not detect a person approaching the doors. This system may also be configured to prevent door opening in the event a person bypasses a more distant detection system, in order to prevent the person being hit by the doors upon opening.

The present doors may be constructed of any practicable material, as desired. Typically, such doors are constructed as a rigid assembly, having a metal (aluminum, etc.) frame with a safety glass insert (indicated by the glass 86 in FIG. 1). However, the door panels used with the present automated bi-folding door system, may be constructed of any suitable opaque, translucent, and/or transparent materials or combination thereof, as desired. The present bi-folding doors will prove to be of great value to owners and operators of virtually any type of public access structure and/or structure having high levels of pedestrian traffic through its entrances, as the advantageous safety features and lack of requirement for maintenance and repair after power failure, will result in significant economies of operation during the lifetime of the system.

It is to be understood that the present invention is not limited to the embodiment described above, but encompasses any and all embodiments within the scope of the following claims.

We claim:

1. In a doorway having an interior, an exterior, a first jamb, a second jamb opposite the first jamb, and a lintel extending thereacross with the first and second jamb and lintel defining a doorway plane, a powered, automated bi-folding door. comprising:

a first jamb panel and a second jamb panel, each panel having a jamb contact edge, a main panel attachment edge opposite said jamb attachment edge, and an interior and exterior face defining a thickness therebetween;

said jamb contact edge of each said jamb panel being hingely attached adjacent the respective jamb of the doorway;

a first main panel and a second main panel, each of the main panels having a jamb panel attachment edge, a main panel contact edge opposite said jamb attachment edge, an upper edge, a door panel plane with a vertical axis disposed centrally through said door panel plane, and an interior and exterior face defining a thickness therebetween;

said jamb panel attachment edge of each said main panel being hingedly attached to said main panel attachment edge of the respective said jamb panel;

automated drive means permanently connected to said upper edge of each said main panel for moving each said main panel and corresponding hingedly attached jamb panel along the doorway lintel and pivoting each said main panel about said vertical axis thereof, with said main panel contact edge of each said main panel pivoting to the exterior of the doorway and with each said first panel and each said second panel traveling toward the respective jamb of the doorway when said drive means is actuated to a door open condition, and for aligning each said panel with one another in a closed, coplanar disposition when said drive means is actuated to a door closed condition;

means for manually opening each said panel from a door closed condition to a door open condition by manually applying an opening force to said interior face of at least one said main panel at said main panel contact edge thereof and precluding disengagement of either said main panel from said drive means;

a first and a second arcuate slotted cam depending from drive means, and extending from the doorway plane toward the interior of the doorway;

said upper edge of each said main panel including a cam roller extending therefrom, and extending from said door panel plane toward the interior of the doorway and engaging the respective said slotted cam; and each said slotted cam driving the respective said cam roller toward the interior of the doorway when said drive means is initially actuated to a door open condition for breaking each said panel from its mutually coplanar closed condition for folding, and each said slotted cam further driving the respective said cam roller toward the doorway plane when said drive means is actuated to a door closed condition for positioning each said panel in a closed, mutually coplanar disposition.

2. The bi-folding door according to claim 1, further including:

jamb panel hinge means extending from said main panel attachment edge of each said jamb panel, substantially coplanar with said exterior face thereof;

main panel hinge means extending from said jamb panel attachment edge of each said main panel, substantially coplanar with said exterior face thereof;

said jamb panel attachment edge of each said main panel being hingedly attached to said main panel attachment edge of the respective said jamb panel by said jamb panel and said main panel hinge means; and each said jamb panel and each respective said main panel defining a relief area between said main panel attachment edge of said jamb panel and said jamb panel attachment edge of the respective said main panel attached thereto, for precluding capture of an article therein when each said panel is actuated to a closed, mutually coplanar condition.

3. The bi-folding door according to claim 1, wherein said automated drive means comprises:

a drive motor;

a drive pulley driven by said drive motor;

an idler pulley opposite said drive motor;

an endless belt extending around said drive pulley and said idler pulley;

said endless belt having a first drive run and a second drive run opposite said first drive run, with each said drive run moving in opposite directions to one another when said drive motor is actuated;

a first drive trolley affixed to said first drive run of said belt, and a second drive trolley affixed to said second drive run of said belt; and said first and said second drive trolley respectively having said first and said second arcuate slotted cam depending therefrom and engaging a respective said cam roller of each said main panel for actuating each said main panel.

4. The bi-folding door according to claim 1, wherein:

each said jamb panel has a width substantially one half that of each said main panel; and said vertical axis of each said main panel remains in the doorway plane at all times, with substantially one half of each said main panel extending to the interior and to the exterior of the doorway when in other than a completely closed condition.

5. The bi-folding door according to claim 1, wherein:

said first jamb panel and said first main panel comprise a first panel assembly;

said second jamb panel and said second main panel comprise a second panel assembly; and said first panel assembly and said second panel assembly have substantially equal widths and areas to one another and are laterally symmetrically disposed within the doorway.

6. The bi-folding door according to claim 1, wherein each of said panels comprises a rigid door panel having a safety glass insert.

7. In a doorway having an interior, an exterior, a first jamb, a second jamb opposite the first jamb, and a lintel extending thereacross with the first and second jamb and lintel defining a doorway plane, a powered, automated bi-folding door, comprising:

a first jamb panel and a second jamb panel, each jamb panel having a jamb contact edge, a main panel attachment edge opposite said jamb contact edge, and an interior and exterior face defining a thickness therebetween;

said jamb contact edge of each said jamb panel being hingedly attached adjacent the respective jamb of the doorway;

a first main panel and a second main panel, each main panel having a jamb panel attachment edge, a main panel contact edge opposite said jamb attachment edge, an upper edge, a door panel plane with a vertical axis disposed centrally through said door panel plane, and an interior and exterior face defining a thickness therebetween;

said jamb panel attachment edge of each said main panel being hingedly attached to said main panel attachment edge of the respective said jamb panel;

automated drive means permanently connected to said upper edge, of each said main panel for moving each said main panel and corresponding hingedly attached jamb panel along the doorway lintel and pivoting each said main panel about said vertical axis thereof, with said main panel contact edge of each said main panel pivoting to the exterior of the doorway and with each said first panel and each said second panel traveling toward the respective jamb of the doorway when said drive means is actuated to a door open condition, and for aligning each said panel with one another in a closed, coplanar disposition when said drive means is actuated to a door closed condition;

said drive means including a first and a second arcuate slotted cam depending therefrom, and extending from the doorway plane toward the interior of the doorway;

said upper edge of each said main panel including a cam roller extending therefrom, and extending from said door panel plane toward the interior of the doorway and engaging the respective said slotted cam; and each said slotted cam driving the respective said cam roller toward the interior of the doorway when said drive means is initially actuated to a door open condition for breaking each said panel from its mutually coplanar closed condition for folding, and each said slotted cam further driving the respective said cam roller toward the doorway plane when said drive means is actuated to a door closed condition for positioning each said panel in a closed, mutually coplanar disposition.

8. The bi-folding door according to claim 7, further including:

means for manually opening each said panel from a door closed condition to a door open condition by manually applying an opening force to said interior face of at least one said main panel at said main panel contact edge thereof and precluding disengagement of either said main panel from said drive means.

9. The bi-folding door according to claim 7, further including:

jamb panel hinge means extending from said main panel attachment edge of each said jamb panel, substantially coplanar with said exterior face thereof;

main panel hinge means extending from said jamb panel attachment edge of each said main panel, substantially coplanar with said exterior face thereof;

said jamb panel attachment edge of each said main panel being hingedly attached to said main panel attachment edge of the respective said jamb panel by said jamb panel and said main panel hinge means; and each said jamb panel and each respective said main panel defining a relief area between said main panel attachment edge of said jamb panel and said jamb panel attachment edge of the respective said main panel attached thereto, for precluding capture of an article therein when each said panel is actuated to a closed, mutually coplanar condition.

10. The bi-folding door according to claim 7, wherein said automated drive means comprises:

a drive motor;

a drive pulley driven by said drive motor;

an idler pulley opposite said drive motor;

an endless belt extending around said drive pulley and said idler pulley;

said endless belt having a first. drive run and a second drive run opposite said first drive run, with each said drive run moving in opposite directions to one another when said drive motor is actuated;

a first drive trolley affixed to said first drive run of belt, and a second drive trolley affixed to said second drive of said belt; and said first and said second drive trolley respectively having said first and said second arcuate slotted cam depending therefrom and engaging a respective said cam roller of each said main panel for actuating each said main panel.

11. The bi-folding door according to claim 7, wherein:

each said jamb panel has a width substantially one half that of each said main panel; and said vertical axis of each said main panel remains in the doorway plane at all times, with substantially one half of each said main panel extending to the interior and to the exterior of the doorway when in other than a completely closed condition.

12. The bi-folding door according to claim 7, wherein:

said first jamb panel and said first main panel comprise first panel assembly;

said second jamb panel and said second main panel comprise a second panel assembly; and said first panel assembly and said second panel assembly substantially equal widths and areas to one another and laterally symmetrically disposed within the doorway.

13. The bi-folding door according to claim 7, wherein each of panels comprises a rigid door panel having a safety glass insert.

14. In a doorway having an interior, an exterior, a first jamb, a second jamb opposite the first jamb, and a lintel extending thereacross with the first and second jamb and lintel defining a doorway plane, a powered, automated bi-folding door, comprising:

a first jamb panel and a second jamb panel, each jamb panel having a jamb contact edge, a main panel attachment edge opposite said jamb contact edge, and an interior and exterior face defining a thickness therebetween;

jamb panel hinge means extending from said main panel attachment edge of each said jamb panel, substantially coplanar with said exterior face thereof;

a first main panel and a second main panel, each main panel having a jamb panel attachment edge, a main panel contact edge opposite said jamb attachment edge, an upper edge, a door panel plane with a vertical axis disposed centrally through said door panel plane, and an interior and exterior face defining a thickness therebetween;

main panel hinge means extending from said jamb panel attachment edge of each said main panel, substantially coplanar with said exterior face thereof;

said jamb contact edge of each said jamb panel being hingedly attached adjacent the respective jamb of the doorway;

said jamb panel attachment edge of each said main panel being hingedly attached to said main panel attachment edge of the respective said jamb panel by said jamb panel and said main panel hinge means;

each said jamb panel and each respective said main panel defining a relief area between said main panel attachment edge of said jamb panel and said jamb panel attachment edge of the respective said main panel attached thereto, for precluding capture of an article therein when each said panel is actuated to a closed, mutually coplanar condition;

a first and a second arcuate slotted cam depending from said drive means, and extending from the doorway plane toward the interior of the doorway;

said upper edge of each said main panel including a cam roller extending therefrom, and extending from said door panel plane toward the interior of the doorway and engaging the respective said slotted cam; and each said slotted cam driving the respective said cam roller toward the interior of the doorway when said drive means is initially actuated to a door open condition for breaking each said panel from its mutually coplanar closed condition for folding, and each said slotted cam further driving the respective said cam roller toward the doorway plane when said drive means is actuated to a door closed condition for positioning each said panel in a closed, mutually coplanar disposition.

15. The bi-folding door according to claim 14, further including: means for manually opening each said panel from a door closed condition to a door open condition by manually applying an opening force to said interior face of at least one said main panel at said main panel contact edge thereof and precluding disengagement of either said main panel from said drive means.

16. The bi-folding door according to claim 14, wherein said automated drive means comprises:

a drive motor;

a drive pulley driven by said drive motor;

an idler pulley opposite said drive motor;

an endless belt extending around said drive pulley and said idler pulley;

said endless belt having a first drive run and a second drive run opposite said first drive run, with each said drive run moving in opposite directions to one another when said drive motor is actuated;

a first drive trolley affixed to said first drive run of said belt, and a second drive trolley affixed to said second drive run of said belt; and said first and said second drive trolley respectively having said first and said second arcuate slotted cam depending therefrom and engaging a respective said cam roller of each said main panel for actuating each said main panel.

17. The bi-folding door according to claim 14, wherein:

each said jamb panel has a width substantially one half that of each said main panel; and said vertical axis of each said main panel remains in the doorway plane at all times, with substantially one half of each said main panel extending to the interior and to the exterior of the doorway when in other than a completely closed condition.

18. The bi-folding door according to claim 14, wherein:

said first jamb panel and said first main panel comprise a first panel assembly;

said second jamb panel and said second main panel comprise a second panel assembly; and said first panel assembly and said second panel assembly have substantially equal widths and areas to one another and are laterally symmetrically disposed within the doorway.

* * * * *